US006116478A

United States Patent [19]

Storar et al.

[11] Patent Number: 6,116,478

[45] Date of Patent: Sep. 12, 2000

[54] LIMITED POUR NECK FINISH BOTTLE AND METHOD OF MAKING SAME

[75] Inventors: James R. Storar, Buena; John D. Buehler, Bridgeton, both of N.J.

[73] Assignee: Comar Inc., Buena, N.J.

[21] Appl. No.: 09/082,475

[22] Filed: May 21, 1998

[51] Int. Cl.[7] ..... B67D 3/00; B67D 5/58; A47G 19/24; B65D 1/02

[52] U.S. Cl. ..... 222/564; 222/189.04; 222/547; 222/565; 215/40

[58] Field of Search ..... 222/547, 564, 222/565, 189.02, 189.03, 189.04; 215/40, 274

[56] References Cited

U.S. PATENT DOCUMENTS

| | | | |
|---|---|---|---|
| 2,627,619 | 2/1953 | Gagen | 401/122 |
| 2,886,218 | 5/1959 | Marcus | 222/517 |
| 2,983,946 | 5/1961 | Edelstone et al. | 401/122 |
| 4,132,442 | 1/1979 | Larsson | 294/25 |
| 4,502,606 | 3/1985 | Shillington et al. | 215/274 |
| 4,600,112 | 7/1986 | Shillington et al. | 215/274 |
| 4,784,505 | 11/1988 | Dahm | 401/122 |

*Primary Examiner*—Kevin Shaver
*Assistant Examiner*—Keats Quinalty
*Attorney, Agent, or Firm*—Eugene E. Renz, Jr. PC

[57] ABSTRACT

A limited pour neck finish bottle wherein a plurality of radially inwardly extending flexible fingers are integral with the peripheral edge portion of the open end of the neck of a bottle and extend across the open end of the neck to restrict or interfere with the flow of liquid from the bottle if an attempt is made to pour the liquid from the bottle rather than employing an exact dose dispensing device. The bottle is made by molding a plurality of axially extending flexible fingers on the peripheral edge portion at the open end of the neck simultaneously with the molding of the bottle, and then bending the fingers downwardly to the radially inwardly extending position.

3 Claims, 1 Drawing Sheet

FIG. 1
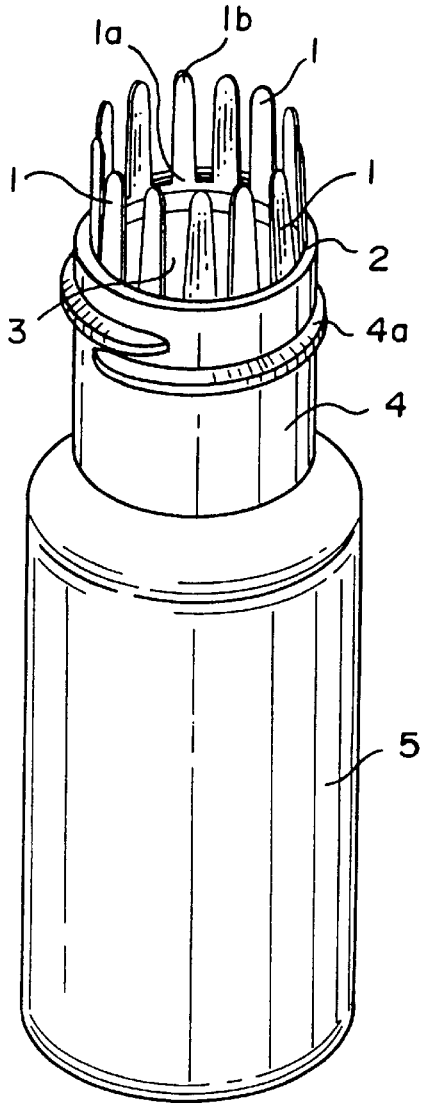
FIG. 2
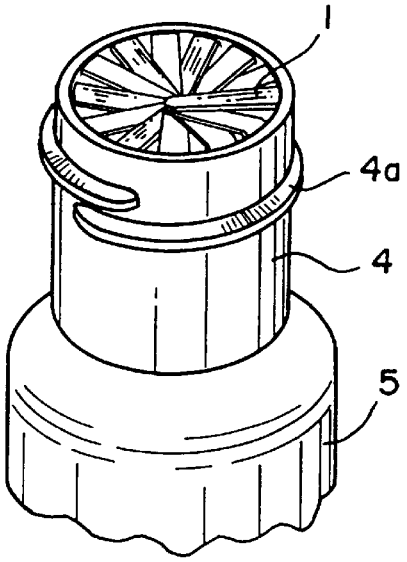
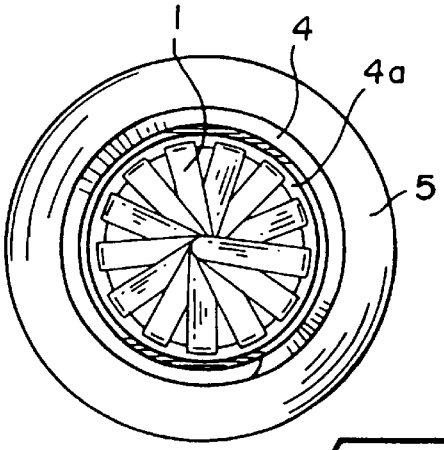
FIG. 3
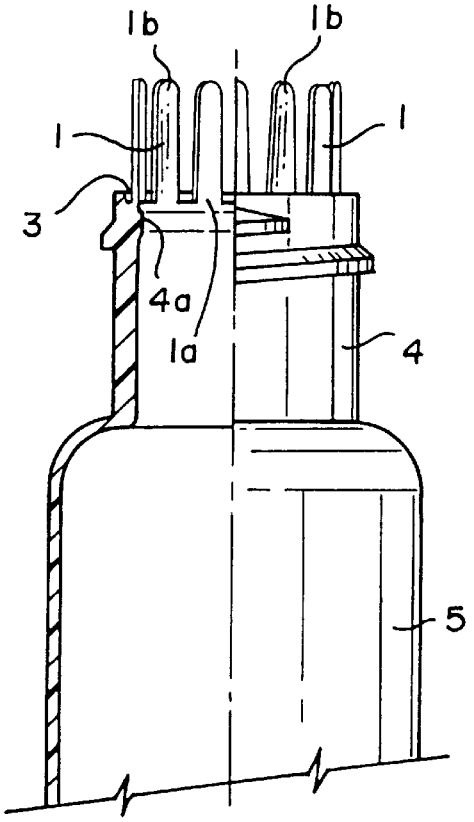
FIG. 4

LIMITED POUR NECK FINISH BOTTLE AND METHOD OF MAKING SAME

BACKGROUND OF THE INVENTION

It has been known to provide the open end necks of bottles with various types of wipers for wiping the exterior of dispensing devices, such as a dropper or brush employed for dispensing fluid from the bottle. Such wipers are disclosed in U.S. Pat. Nos. 2,627,619; 2,983,946; and 4,784,505. While these wipers have been satisfactory for their intended purpose, the wiper portion has typically been a separate component from the bottle requiring the wiper member and bottle to be manufactured in separate operations and then conveyed to an assembly location where the wiper members are attached to the bottles; thus, adding to the cost of manufacturing a bottle having a wiper.

After considerable research and experimentation, the neck finish bottle of the present invention has been devised to reduce the cost of manufacturing a bottle having not only a wiper, but also a flow restricter to limit or interfere with the flow of liquid medicament from the bottle if an attempt is made to pour the liquid from the bottle, rather than employing an exact dose dispenser, such as a dropper or syringe, intended for use with the bottle.

SUMMARY OF THE INVENTION

The limited pour neck finish bottle of the present invention comprises, essentially, a plurality of circumferentially spaced, radially inwardly extending fingers integral with the circumferential or peripheral edge portion at the open end of the tubular neck of a bottle.

When the bottle is made of plastic, the fingers are molded simultaneously with the bottle and extend axially outwardly from the open end of the bottle neck. The outer end portions of the fingers are then pushed downwardly to thereby bend the fingers to the radially inwardly extending position.

BRIEF DESCRIPTION OF THE DRAWINGS

FIG. 1 is a perspective view of the limited pour neck finish bottle of the present invention showing the flexible fingers extending in the axially outwardly extending position;

FIG. 2 is a fragmentary perspective view of the bottle illustrated in FIG. 1 showing the fingers bent to the radially inwardly extending position;

FIG. 3 is a top plan view of the bottle shown in FIG. 2; and

FIG. 4 is a fragmentary, sectional, side elevational view of the bottle shown in FIG. 1.

DESCRIPTION OF THE PREFERRED EMBODIMENTS

Referring to the drawings and, more particularly, to FIG. 1, the limited pour neck finish bottle of the present invention comprises a plurality of peripherally or circumferentially spaced, tapered fingers 1 integral with the circumferential edge portion 2 at the open end 3 of the tubular neck 4 of a bottle 5, the neck also having a thread portion 4*a* for receiving a suitable threaded closure, not shown.

As will be seen in FIG. 4, the bottle 5 and fingers 1 are of molded plastic with the base 1*a* of each finger being molded integral with the inner surface 4*a* of the neck 4 at the open end 3 thereof.

After the initial fabrication of the bottle is completed, as shown in FIGS. 1 and 4, the outer end portions 1*b* of the fingers 1 are pushed downwardly, to thereby bend each finger 1*b* at its base 1*a*, whereby the fingers 1 extend radially inwardly across the open end 3 of the neck 4, as shown in FIGS. 2 and 3, wherein the outer end portions 1*b* of the fingers overlap each other.

The overlapping of the outer end portions 1*b* of the fingers provides a restriction across the open end 3 of the neck 4 so that the flow of liquid from the bottle 5 will be limited or interfered with if the bottle 5 is tilted to pour the liquid therefrom. This is an important feature of the present invention, particularly, if the bottle 4 contains a liquid medicament wherein an exact does has been prescribed requiring the use of a dropper or syringe for dispensing the prescribed exact dose. The limited pour neck finish provided by the overlapped fingers 1 will substantially interfere with the pouring of the liquid medicament from the bottle 4. The overlapped fingers 1 also provide a wiper for wiping the liquid medicament from the outer surface of the exact dose dispenser as it is pulled out of the bottle 5.

From the above description, it will be appreciated by those skilled in the art that the construction and arrangement of the limited pour neck finish bottle of the present invention not only interferes with the flow of liquid from the bottle if an attempt is made to pour the liquid from the bottle, but it also provides a wiper for an exact dose dispenser intended for use with the bottle. Also by molding the bottle 4 and fingers 1 simultaneously and integrally with each other, the cost of manufacturing the limited pour neck finish bottle is greatly reduced.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

We claim:

1. A limited pour neck finish bottle comprising a bottle having a tubular neck, and neck having an open end, a plurality of peripherally spaced, radially inwardly extending fingers integral with a peripheral edge portion at the open end of said tubular neck, to thereby provide a restriction across the open end of said tubular neck, whereby the flow of liquid from the bottle is limited if the bottle is tilted to pour the liquid therefrom wherein each finger is tapered having a wide base portion and a relatively narrower free end portion, wherein the open end of the neck has an inner surface, the base portion of each finger being integral with said inner surface, wherein the free end portion of said fingers overlap each other.

2. The limited pour neck finish bottle according to claim 1, wherein the neck of the bottle is cylindrical and the fingers are circumferentially spaced.

3. The limited pour neck finish bottle according to claim 1, wherein each finger is flexible.

* * * * *